US011298629B2

(12) United States Patent
Holden

(10) Patent No.: US 11,298,629 B2
(45) Date of Patent: Apr. 12, 2022

(54) BALL TOY

(71) Applicant: MEJJJET HOLDINGS PTY LTD, Margate (AU)

(72) Inventor: Edward Holden, Margate (AU)

(73) Assignee: MEJJJET HOLDINGS PTY LTD, Margate (AU)

( * ) Notice: Subject to any disclaimer, the term of this patent is extended or adjusted under 35 U.S.C. 154(b) by 0 days.

(21) Appl. No.: 17/191,188

(22) Filed: Mar. 3, 2021

(65) Prior Publication Data

US 2021/0187407 A1 Jun. 24, 2021

Related U.S. Application Data

(63) Continuation of application No. 16/755,369, filed as application No. PCT/AU2018/051098 on Oct. 10, 2018, now Pat. No. 10,967,290.

(30) Foreign Application Priority Data

Oct. 10, 2017 (AU) ..... 2017904076

(51) Int. Cl.
*A63H 33/18* (2006.01)
*A63H 1/00* (2019.01)

(52) U.S. Cl.
CPC ..... *A63H 33/18* (2013.01); *A63H 1/00* (2013.01)

(58) Field of Classification Search
CPC ..... A63H 11/00; A63H 15/08; A63H 33/18; A63B 21/075
USPC ..... 446/233, 437, 486; 482/107
See application file for complete search history.

(56) References Cited

U.S. PATENT DOCUMENTS

| | | | | |
|---|---|---|---|---|
| 2,949,696 | A | 8/1960 | Easterling | |
| 3,798,835 | A | 3/1974 | McKeehan | |
| 5,297,981 | A | 3/1994 | Maxim et al. | |
| 5,857,892 | A * | 1/1999 | Leadbetter | A63H 33/00 446/431 |
| 7,381,157 | B2 * | 6/2008 | Blateri | A63B 21/075 482/106 |
| 10,322,327 | B2 * | 6/2019 | Shaw | A63F 7/40 |
| 2011/0214616 | A1 | 9/2011 | Levin et al. | |
| 2014/0141944 | A1 | 5/2014 | Johnson et al. | |

FOREIGN PATENT DOCUMENTS

WO 2011083313 A1 7/2011

OTHER PUBLICATIONS

International Preliminary Report on Patentability for PCT/AU2018/051098, dated Jun. 12, 2019, 17 pgs.
International Search Report and Written Opinion for PCT/AU2018/051098, dated Jan. 25, 2019, 9 pgs.

* cited by examiner

*Primary Examiner* — Kien T Nguyen
(74) *Attorney, Agent, or Firm* — Armstrong Teasdale LLP

(57) ABSTRACT

A ball toy having a solid, resiliently flexible body is disclosed. The body is penetrated by a bore, wherein bearing means are mounted, defining a rotational axis of the body therein. The bore has a bore closure at each end, mechanical connection means connecting each closure to the bearing means. The body is able to spin on said axis relative to the closures, when the closures are held in a pinching manner by a user. The body is made of a thermoplastic rubber of selected hardness properties, giving it excellent bouncing performance, with unpredictability of bouncing direction resulting from the spinning of the body.

18 Claims, 3 Drawing Sheets

BALL TOY

CROSS REFERENCE TO RELATED APPLICATIONS

This patent application is a continuation of U.S. patent application Ser. No. 16/755,369 filed on Apr. 10, 2020, which is a National Stage Entry of PCT/AU2018/051098 filed on Oct. 10, 2018, which claims priority to AU Application No. 2017904076 filed on Oct. 10, 2017, the disclosures of which are hereby incorporated by reference herein in their entirety as part of the present application.

FIELD OF THE DISCLOSURE

This disclosure relates to a ball toy adapted for bouncing and spinning. More specifically, it relates to a bounceable ball having a bearing component about which the ball can be made to spin so as to cause direction change when the ball is bounced. The ball may be rolled, tossed, or struck with a bat or similar implement.

BACKGROUND

The demand for new novelty toys and games is continuous, with ball toys being popular across a wide range of demographics. Ball designs known in the art are wide and varied, with different sizes, shapes and manufacturing materials effecting the way the ball behaves when bounced or thrown.

In some instances, additional functionality may be included within a ball toy to influence the trajectory of the ball in flight. Such devices known in the art include the motor driven ball toy described in U.S. Pat. No. 3,798,835, where an electric motor is retained inside the core of a ball, or U.S. Pat. No. 2,563,019, which uses a combination of pulleys and springs to actuate movement of the ball in various directions. Devices such as these are somewhat effective, but the large number of moving parts makes them prone to breakage, as well as being uneconomical to manufacture.

International patent publication WO 2011/083313 describes a self-powered toy in the form of a hollow ball defining a shell within which a kinetic energy-storing flywheel is mounted rigidly to a shaft, which is held in position at either end by a low friction collar. The ball is operated by inserting a rotating shaft into charging hole in the shell and pressing it against a friction device in the form of a bevel gear. This causes the flywheel to rotate and store kinetic energy. The low friction collars constitute bearings and define between them a rotational axis for the shaft.

A drawback of prior art spinning ball toys of the kind disclosed in WO 2011/083313 is that they have poor bouncing characteristics. Flexibility and resilience of the body are found to be compromised when the interior of the ball is hollowed out to accommodate mechanical components. It would be advantageous to have a ball toy that enables changes in trajectory, speed and orientation when thrown or bounced, while having a minimal amount of moving parts that may be damaged when the ball toy is in use.

BRIEF DESCRIPTION

The present disclosure addresses shortcomings of the prior art and, in doing so, provides a bouncing ball toy adapted to spin on at least a single axis.

The preceding discussion of the background is intended to facilitate an understanding of the present disclosure. However, it should be appreciated that the discussion is not an acknowledgement or admission that any of the material referred to was part of the common general knowledge in Australia or elsewhere as at the priority date of the present application.

Further, and unless the context clearly requires otherwise, throughout the description and the claims, the words 'comprise', 'comprising', and the like are to be construed in an inclusive sense of "including, but not being limited to"—as opposed to an exclusive or exhaustive sense, meaning "including this and nothing else".

According to a first aspect, there is provided, in the present disclosure, a ball toy having a solid, resiliently flexible body penetrated by a bore, bearing means mounted within the bore such that a rotational axis of the body is defined therein, a bore closure at each end of the bore, mechanical connection means connecting each closure to the bearing means, whereby the body is able to spin on said axis relative to the closures, when the closures are held in a pinching manner by a user.

In an embodiment, the bearing means includes a single rolling element bearing. The bearing has an outer ring securely inserted into the body and a relatively revolving inner ring secured to the mechanical connection means.

The mechanical connection means may include a shaft mounted within, to be co-rotatable with, the inner ring.

The closure means may be connected to respective free ends of the shaft.

The shaft may be possessed of stiffness greater than that of the body. It is desirably made of a thermoplastics compound. Further preferably, the compound has a hardness on the Shore D durometer scale in the range 75 to 83. The shaft is manufactured from material preferably having a tensile strength in the range from 10000 psi to 12000 psi. An example of a preferred material is polyoxymethylene ("POM"), also known as acetal.

The shaft may be resiliently deformable to a relatively small extent in sympathy with the bore, when the body is subjected to bouncing impact. Consequently, the shaft is adapted to remain free and able to rotate independently of the body, even during deformation from bouncing action.

The ball may be generally spherical or of generally flatter proportions tending to being elliptical or oval in shape. It may have a continuous or discontinuous outer surface, for example including panels or facets. For example, it may be geodesic polyhedron-shaped.

In an embodiment, the body is adapted to exhibit enhanced bouncing ability. Bouncing ability is considered enhanced when a spherical body dropped on to a smooth cement surface from a height of 1 m bounces to a height of at least 530 mm. The ball of the disclosure may be adapted to bounce to a height of at least 720 mm.

The body may be adapted by including a thermoplastic rubber. The thermoplastic rubber may have a hardness value in the range 34 to 50 according to the Shore durometer Type A hardness scale. In an embodiment, the hardness value is in the range from 38 to 47. Ideally, the hardness number is 40 on the Shore A durometer scale.

The thermoplastic rubber may be adapted to a desired hardness or elasticity by including minor proportions of compounds selected from one or more of SEBS (Styrene Ethylene Butylene Styrene), SBS (Styrene Butadiene Styrene), polypropylene (PP) and expanded rubbers, including polyurethane, natural latex and polyethylene.

In a further embodiment, the bore closures at each end of the bore include caps manufactured from a thermoplastic elastomer (TPE).

In a still further embodiment, the caps have a hardness value that exceeds that of the body. The caps may have a hardness value in the range 40 to 60, more preferably in the range 45 to 55 on the Shore A scale. In an embodiment, the caps are of 50 degree hardness on the Shore A scale.

In an embodiment, the bore has a lining along at least a major portion of its length. The lining may have a Shore hardness in a range from the hardness of the body to the hardness of the caps. Further, the lining may equal the hardness of the caps. The lining may include a polymer. By way of example, the lining includes polyvinyl chloride.

In a further embodiment, the bearing means includes first and second roller bearings connected to the shaft and located along the shaft in spaced relationship to each other.

BRIEF DESCRIPTION OF THE DRAWINGS

In order that the disclosure may be readily understood, and put into practical effect, reference will now be made to the accompanying figures. Thus.

DETAILED DESCRIPTION

The ball of the present disclosure provides a toy that can be used both as a ball with which to play games and as a spinning "fidget" device, useful to provide stress relief or simply to keep a user's hands busy.

The ball may be formed in a range of sizes colours and shapes, with the concepts described herein able to be adapted to a wide range of ball types, shapes sizes and materials. It is envisaged that the balls will be typically manufactured to a size that can readily be held in the palm of a hand in order to effectively use the ball as a fidget device and for bouncing and throwing. The ball may be manufactured in different sizes to suit the hand sizes of children and adults respectively.

Figure 1A:
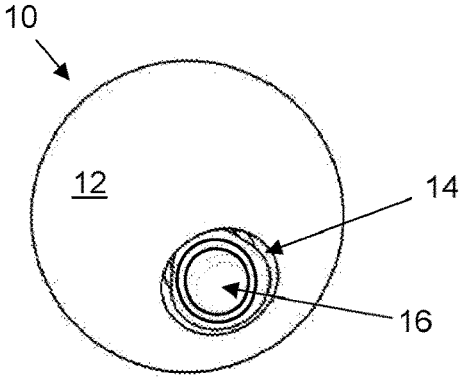
FIG. 1A is a perspective view and FIG. 1B is a radial side view orthogonal to an axis of rotation of a bouncing ball in one embodiment.
Figure 1B:
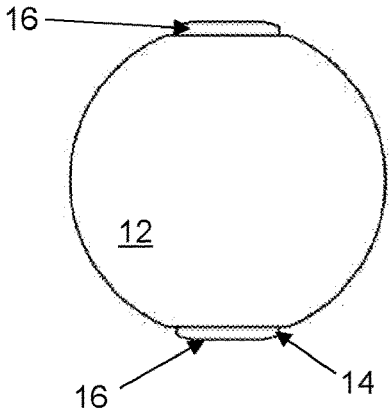
Figure 2:
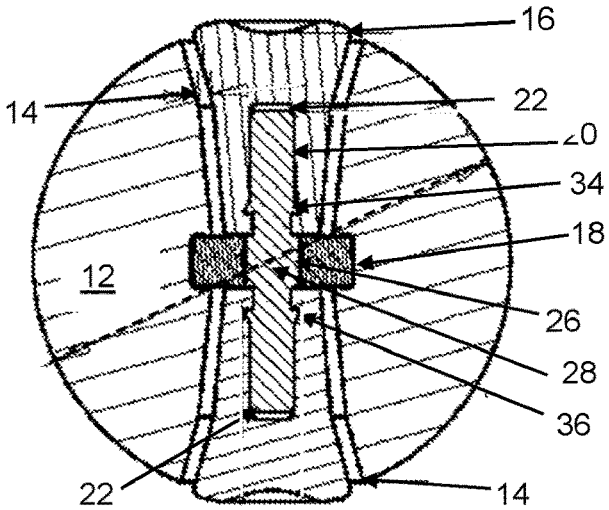
FIG. 2 is an axial cross section of the ball of FIGS. 1A and 1B.
Figure 4:
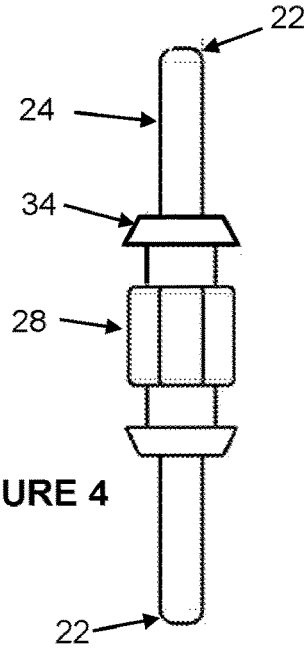
FIG. 4 is a side view of the rotating shaft of FIG. 2.
Figure 3:
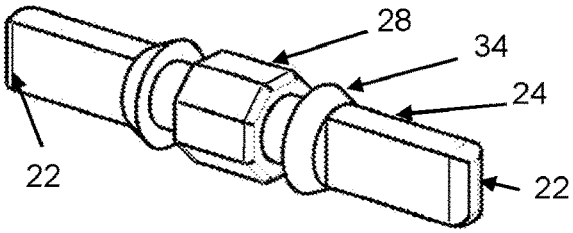
FIG. 3 is a perspective view of the rotating shaft of FIG. 2.
Figure 6:
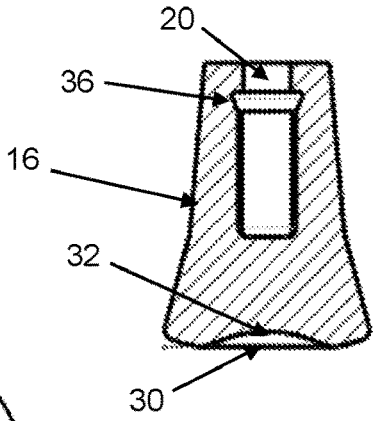
FIG. 6 is an axial cross section of the cap of FIG. 5.
Figure 5:
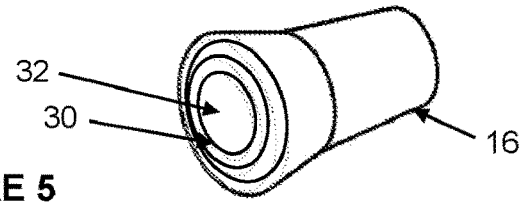
FIG. 5 is a perspective view of the end cap that fits to the shaft of FIGS. 3 and 4, as shown in FIGS. 1A, 1B, and 2.

Referring to FIGS. 1A and 1B, in one embodiment of this disclosure, a spinning bouncing ball 10 is shown in perspective view in FIG. 1A and side view in FIG. 1B. Like numbering denotes like components. The ball includes a body 12, which is solid and made of thermoplastic rubber, except for a bore 14 passing diametrically through it from surface to surface. At each end, the bore is closed by an end cap 16 against insertion of fingers and like appendages, as well as most other foreign objects. As shown in FIG. 1B, the end caps protrude slightly from the body, but remain almost entirely within an imaginary volume defined by putative extension of the circumference of the circle defining the sphere of the body. While in this embodiment the end caps may not protrude further, it is envisaged that in an alternative embodiment at least one of the caps may be shaped and sized to protrude further, either for assisting the grip of a user, or for causing unpredictable bounce should the ball when thrown strike a surface axially. The caps have rounded circumferential edges to assist in avoiding laceration to a ball player catching the ball inconveniently, or to a person happening to be struck.

In this embodiment, the body has a diameter of 55 mm, but may vary within acceptable manufacturing tolerances. It will be appreciated that the body size is not essential to the ball toy of this disclosure and may be larger, with a diameter in the range 55 mm to 65 mm, or smaller, subject to limitations such as choking hazard considerations for small children.

The end caps 16 are not connected directly to the body and are able to rotate freely and independently of the body by virtue of a roller bearing assembly 18, as explained below with additional reference to FIGS. 3 to 6, in which like parts have like numbering.

The end caps have an internal socket 20 of rectangular, anti-rotational axial cross-section that is shaped to fit snugly fitted over the respective opposite ends 22 of a rotatable shaft 24 mounted within bore 14. Shaft 24 is a single-piece component push-fitted into the central bore 26 of roller bearing assembly 18. The shaft has a octagonally faceted mid-portion 28 that is accommodated against rotation into the inner rotating ring of the bearing assembly, which has a complementally configured axial profile. The shaft and the end caps define a unitary assembly that is rotatable through the bearing means with respect to the surrounding body.

Each of the end caps 16 has an exposed end face 30 when fitted to shaft 24. The end face is distally located with respect to the end at which socket 20 is formed and is contoured to form a slight depression 32 into which a user is able to place a fingertip. The depression assists in stable engagement for the user's grip when the body of the ball is spun relative to the shaft.

End cap 16 has a flared axial cross section, thicker at the exposed end having depression 32 and tapering to be thinner at the end of socket 20. This shape is found advantageously to assist in maintaining rotational balance by minimising body hollowness at its core.

The end caps are made of a thermoplastic elastomer (TPE). However, the caps have a hardness value that is greater than that of the body. In this embodiment, the caps are of 50 degree hardness. The caps may have hardness in the range 40 to 60. Without wishing to be bound by theory it is surmised that the enhanced spinning performance achievable wider bouncing action by the ball of the disclosure is the result of the hardness difference between caps and ball body. Because the caps are still deformable, but to a slightly lesser extent than the body, when the ball is bounced and the bore deforms, the caps, being harder than the body, maintain greater rotational integrity, in effect bouncing off and away from the deforming wall of the bore.

Being of a plastics compound, the shaft is made stiffer than the body and the caps. When the body deforms under bouncing impact, the shaft deforms with it, but to a relatively limited, smaller extent. The difference in flexure serves to assist in maintaining rotational integrity of the subassembly including the end caps and shaft assembly.

Because of the rigors of use to which the ball is intended to be subjected, the shaft has a thickened portion in the form of a tapering flange 34, located either side of the faceted mid-portion. Each end cap 16 has a complementally shaped recess 36 in socket 20, so that when the end cap is push-fitted on to end 22 of the shaft, the recess receives the flange and retains it against expulsion under deformation during spinning and bouncing action of the ball.

The thermoplastic rubber (TPR) from which the body of the ball is manufactured may be a copolymer or a physical mix of a polymerized plastics material and a rubber. The rubber may be a synthetic rubber, for example polybutadiene. It is found that the rubbery nature of the thermoplastic rubber material, provides a range of deformation that provides performance advantages for the ball, when impacting a hard surface. It is found that for optimum results the TPR hardness needs to be in the range from 34 to 50 on the Shore A scale. The hardness may be in the range from 38 to 47 on the same scale. The finding is surprising in relation to a golf ball, which exhibits impressive bouncing properties on hard surfaces, but has a hardness in excess of 96 on the Shore A durometer scale, or about 60 on the Shore D scale.

The TPR may include additional plastics components for modifying its hardness to the degree found appropriate for bouncing performance. In an example, a body that exhibited a hardness of about 45 on the Shore durometer Type A scale was produced by combining 40 TPR with the following copolymer blocks:

SEBS (Styrene Ethylene Butylene Styrene)+SBS (Styrene Butadiene Styrene)+PP (Polypropylene)+a foam rubber In a further example, a body that exhibited a hardness of about 40 on the Shore durometer Type A scale was produced by combining 30-35 TPR with the copolymer blocks of the previous example. This was about the same hardness resulting from use of a 40 TPR compound alone, demonstrating manufacturing flexibility. The ball construction is finished off by applying end caps of Shore A 50 hardness to the central shaft when connected to the bearing.

Figure 7:
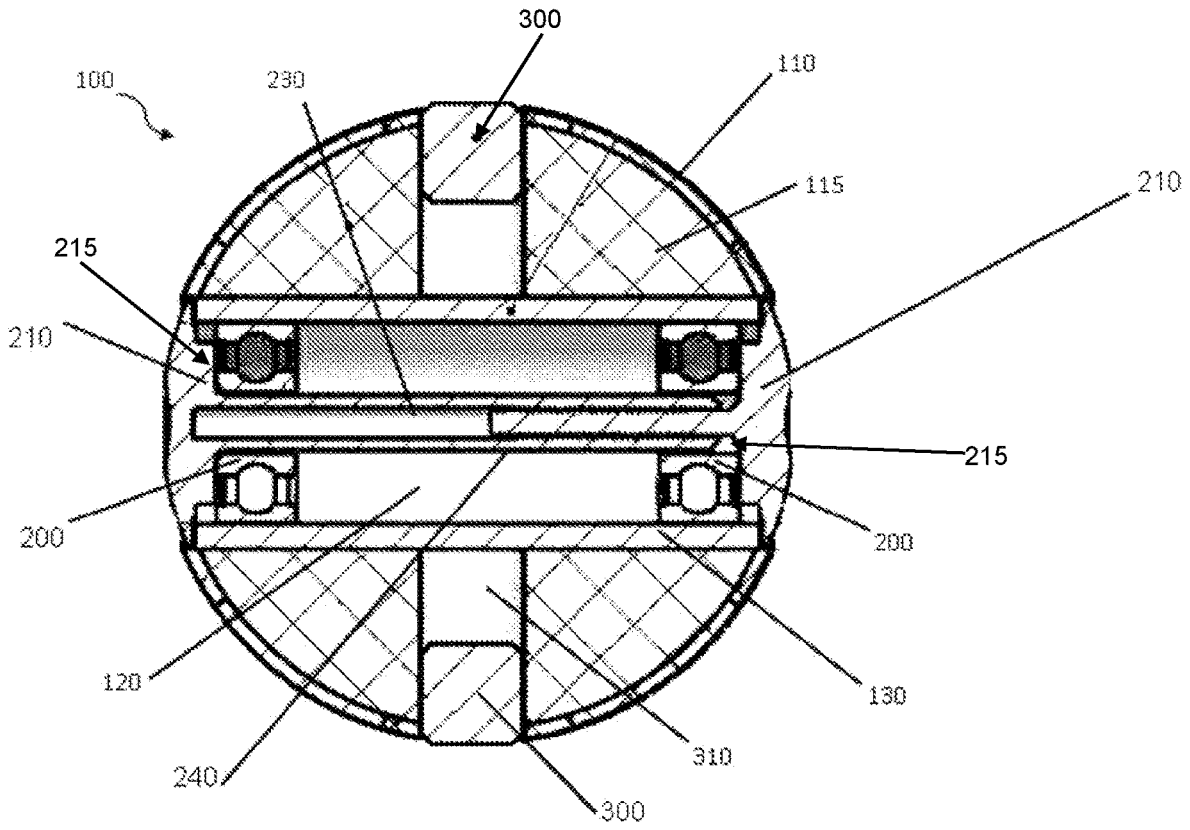
FIG. 7 is a depiction of the ball toy in an alternative embodiment.

A further embodiment of the ball is illustrated in FIG. 7. Ball 100 has end caps 210 sized to form a seal over the otherwise exposed faces 215 of opposed bearings 200. The outer circumference of each cap 210 abuts protective lining 130, preventing cap 210 from being forced into central bore cavity 120 within which the bearings are mounted. Instead of the caps being connected by a shaft passing through a single bearing of the kind shown in the embodiment of FIGS. 1-6, each cap 210 includes a single central tine 230 that extends through cavity 120 and is directly connectable to a mating tine 230 from the opposing cap 210. Tines 230 may connect together using a mechanical connection means such as a clip fit, male-female or lock and key connection means for example. Once tines 230 are connected, caps 210 are retained in position through the central axis formed by the opposing cap 210, forming a unitary subassembly of caps and bearings and a shaft defining a central axis around which the body of ball 100 can be made to spin.

In the embodiment of FIG. 7, bore 120 may be utilised for a number of different purposes. For example, a visual display including LED lights may be mounted within or placed unfixed within the bore cavity. Other materials that create effects when the ball is used may also be incorporated here, such as noise generators (bells, rattles, whistles, electronic sounds) or decorative designs. When visual additions such as LEDS are used in the interior of the ball, the ball may be formed from a transparent material to enable to user to see the effects happening within the interior of the ball.

Optionally, the embodiment of FIG. 7 may include weights 300 within ball 100. The weights contribute to angular momentum, whereby the ball spin velocity can be significantly increased. Weights 300 may be mounted either removably or be fixed within recesses 310 formed within the body of ball 100. The weights 300 may be mounted on opposite sides of ball 100 within opposing recesses 310. Opposing weights provide an even distribution of weight within the ball, providing a smooth spin.

The weights used with ball 100 may be of various different masses, so that balls may be supplied in different ranges of fixed weights or the weights themselves may be removable, allowing the user to select the desired heaviness and inserting the corresponding weights to achieve different weight-dependent performance results.

It is envisaged that in further embodiments, ball 100 may have multiple recesses in which weights may be inserted, with the user able to move weights around the ball in different locations to experiment with changing the behaviour of the ball in flight.

The weights may be formed from coated or uncoated stainless steel, iron or other metals, depending on the desired weight to be used. Other less dense non-metallic or composite materials may also be provided. For removable weights, the weight or weight coating may include a removing means to enable the weight to be inserted and removed from the receiving recess within ball 100

To operate the ball in spinning mode, the user will grasp the ball by the end caps in a pinching-style grip, using thumb and one other finger—conveniently index or middle finger. However, the grip will depend on the size of the user's hand in relation to the ball and the spacing of the exposed faces of the end caps. The user may then use the index finger or thumb of the other hand to impart spin to the ball body while the end caps remain stationary relative to the gripping hand. The user may then drop or throw the spinning ball from their gripping hand and enjoy the effect of the spin on the direction of bounce. The user may learn to manage and control the bounce in a predictable manner through practice of different techniques.

For example, the user may grip the ball by the end caps using one finger from each hand, leaving their thumbs free to spin the ball, before dropping or tossing it onto a suitable surface for enjoyment of the resultant directional change. This kind of grip may be the only grip that is practical for smaller children, because of relative hand size.

In the case of the ball being of relatively large size, for example the size of a football, unless the user has exceedingly large hands, the technique of the previous paragraph may be employed by users old and young.

Figure 8:
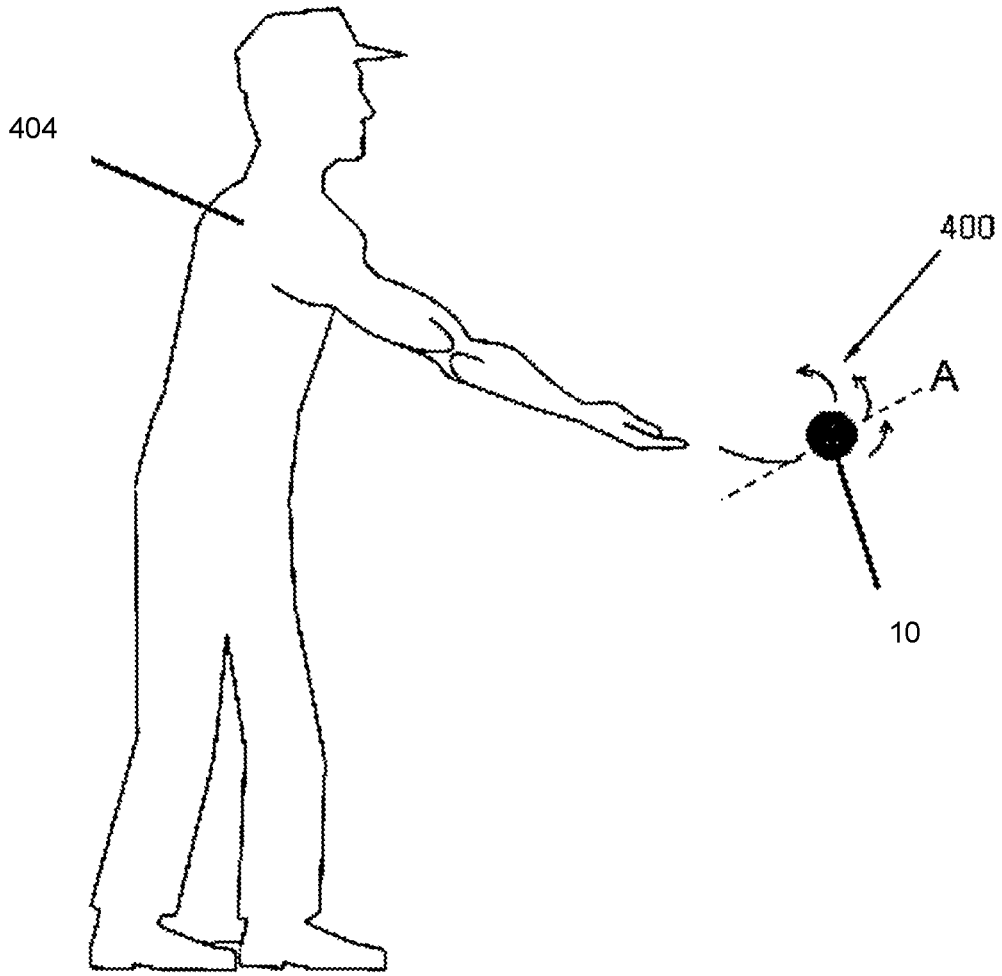
FIG. 8 illustrated a form of use of the ball of the disclosure in a game.

FIG. 8 demonstrates possible motion of the ball toy of any of the embodiments described when used in a throwing or bouncing action. A human user 404 holds the opposing bearings or outer protective cap and spins ball 10 around axis A, which is aligned with shaft 28 of FIGS. 2-4, in the direction of arrows 400. This action itself provides amusement for the user and may be used to occupy fingers and provide stress relief. When used in a ball game, the ball may be spun before being thrown or bounced as shown in FIG. 8, the bearing 18 within providing a spinning motion to the ball which influences the direction of spin.

Although the disclosure has described a ball of generally spherical shape, it is not to be construed to be so limited. The ball may in other embodiments be of generally flatter proportions tending to being elliptical or oval in shape. It may have a continuous or discontinuous outer surface, for example including panels or facets, or be dimpled. The surface need not only be of rubber or a plastics substance, may have an outer coating of fibrous materials or fabric.

The surface against which a ball of the disclosure may be bounced need not be a fixed structure such as court, road or wall, but may also be a bat or similar ball-striking implement. Users may therefore participate in games where the ball is spun and projected from a first user's hand for striking by a second user with a bat. By imparting sufficient spin to the ball, a game may be played in which two or more users strike the spinning ball amongst each other.

These embodiments merely illustrate particular examples of the apparatus of the disclosure providing a toy in the form of a spinning and bouncing ball. With the insight gained from this disclosure, the person skilled in the art is well placed to discern further embodiments by means of which to put the claimed subject matter disclosed herein into practice.

The invention claimed is:

1. A ball toy having:

a. a solid, resiliently flexible body weighted by having a density variation to achieve weight-dependent performance when bouncing;

b. a bore penetrating the body and having opposite open ends;

c. a bearing mounted to the body within the bore to define a rotational axis of the body relative to the bore; and d. bore closures for each end of the bore, operatively connected to the bearing against co-rotation with the body;

wherein the body is able to spin on said axis relative to the bore closures, when the bore closures are held in a pinching manner by a user using one hand.

2. The ball toy of claim 1, wherein the body is weighted by including a weight of different density to the body.

3. The ball toy of claim 2 wherein the body includes a recess within which the weight is mounted.

4. The ball toy of claim 3 wherein the weight is removably mounted.

5. The ball toy of claim 3 having two or more weights providing an even distribution of weight within the ball.

6. The ball toy of claim 5 having first and second weights mounted on opposite sides of the body.

7. The ball toy of claim 3 having a plurality of weights of different masses.

8. The ball toy of claim 2 wherein the weight is of lower density than the body.

9. The ball toy of claim 1, wherein the bearing comprises a rolling element bearing having an outer ring securely inserted into the body and an inner ring for revolving relative to the outer ring and secured to the bore closures, and wherein the bore closures are co-rotatable with the inner ring.

10. The ball toy of claim 9, wherein the bore closures are connected in fixed relationship to said inner ring by a shaft to form a unitary assembly.

11. The ball toy of claim 10, wherein the shaft is adapted to remain free and able to rotate independently of the body during deformation from bouncing action of the ball toy.

12. The ball toy of claim 11, wherein the shaft is resiliently deformable to a relatively small extent in sympathy with the bore, when the body is subjected to bouncing impact.

13. The ball toy of claim 12, wherein the shaft has a stiffness greater than that of the body.

14. The ball toy of claim 13, wherein the shaft is made of a thermoplastics compound which has a hardness on the Shore D durometer scale in the range 75 to 83.

15. The ball toy of claim 14, wherein the shaft is manufactured from material having a tensile strength in the range from 10000 psi to 12000 psi.

16. The ball toy of claim 1, wherein the body is adapted to exhibit enhanced bouncing ability by comprising a thermoplastic rubber having a hardness value in the range 34 to 50 according to the Shore A hardness scale.

17. The ball toy of claim 1 having an outer surface comprising a plurality of discontinuities.

18. The ball toy of claim 1, wherein the bore has a lining along at least a major portion of its length.

* * * * *